United States Patent [19]

Heybey

[11] 4,179,680

[45] Dec. 18, 1979

[54] TEMPERATURE SENSOR

[75] Inventor: Otfried W. G. Heybey, Niles, Mich.

[73] Assignee: Whirlpool Corporation, Benton Harbor, Mich.

[21] Appl. No.: 848,241

[22] Filed: Nov. 3, 1977

[51] Int. Cl.[2] ..... H01C 7/04

[52] U.S. Cl. ..... 338/25; 62/156; 62/158; 338/22 R

[58] Field of Search ..... 338/22 R, 22 SD, 23, 338/25, 28; 62/129, 156, 158; 165/26, 32; 340/585, 588, 584; 29/612, 613; 73/362 AR, 362 SC, 339 R, 343 R

[56] References Cited

U.S. PATENT DOCUMENTS

| | | | |
|---|---|---|---|
| 3,028,586 | 4/1962 | Reda | 340/585 X |
| 3,144,629 | 8/1964 | Curby | 73/362 AR |
| 3,343,151 | 9/1967 | Brown et al. | 338/22 RX |
| 3,485,102 | 12/1969 | Glick | 73/362 AR |
| 3,521,212 | 7/1970 | Waseleski, Jr. et al. | 338/25 |
| 3,594,749 | 7/1971 | Bergeron | 340/588 X |
| 3,594,752 | 7/1971 | Alton | 340/585 |
| 3,634,840 | 1/1972 | Wilkinson | 340/585 X |
| 3,681,993 | 8/1972 | Campton, et al. | 338/28 X |
| 3,707,851 | 1/1973 | McAshan, Jr. | 62/129 X |

*Primary Examiner*—C. L. Albritton

*Attorney, Agent, or Firm*—Wegner, Stellman, McCord, Wiles & Wood

[57] ABSTRACT

A thermally responsive sensor assembly such as for use in providing a warning signal indicating a sensed high temperature condition within a refrigeration apparatus. The sensor assembly includes a temperature detector embedded in a body of synthetic resin material. The detector is disposed within the resin body so as to provide an integrated sensing of the temperature condition existing outwardly of the body. The temperature condition is transmitted to the temperature detector within the body under the joint control of the surface heat transfer coefficient of the body, the thermal conductivity of the body material, and the heat capacity of the body. The resin material preferably has a substantially constant thermal diffusivity over the desired operating range of the sensor assembly. Further, the resin material may have a substantially constant low thermal conductivity over the desired temperature range. The resin material may be a styrenic resin material, such as high impact polystyrene. Alternatively, the resin material may be a rigid polyvinyl chloride material. The thermal path through the resin material to the embedded temperature sensing detector may be approximately 5/16".

10 Claims, 4 Drawing Figures

TEMPERATURE SENSOR

BACKGROUND OF THE INVENTION

1. Field of the Invention

This invention relates to thermally responsive controls for use in refrigeration apparatus and the like and more specifically to temperature sensing detectors for use in such controls.

2. Description of the Prior Art

In controlling refrigeration apparatuses, such as refrigerators, freezers, air conditioners, and the like, it is conventional to utilize temperature sensing detectors providing an automatic control of the operation of the apparatus to provide the desired refrigeration conditions. It has further been known to embed the temperature sensing detector within an enclosing means so as to affect the thermal transfer to the temperature sensing detector in different manners. Thus, illustratively, Bobby D. Blanton et al, in U.S. Pat. No. 3,899,895, show an automatic defrosting control system wherein a thermal relay having a thermally responsive actuating disc is enclosed within a housing including an inner heat sink formed of metal, such as cooper, acting as a thermal reservoir or capacitor, and an outer block of thermal insulation, such as foamed polyurethane.

Another fluid flow detection apparatus is shown in the Edmond A. Salera patent No. 3,199,348 wherein a semiconductor temperature sensor embedded in a glass envelope is further embedded in a thermally semiconductive and electrically insulative material in a cavity defined by a body of heat insulating material, such as ceramic or a plastic, such as epoxy-type resin containing pieces of cork or like highly heat insulative material.

Luther J. Jungemann discloses, in U.S. Pat. No. 3,158,005, owned by the assignee hereof, a structure for providing improved temperature sensing in a refrigeration apparatus, such as an air conditioner, the embedment of the temperature sensing detector in a block of material having limited thermal conductivity, such as a GRS type rubber compound, or neoprene rubber with metallic powder, such as aluminum or zinc oxide, dispersed therein.

SUMMARY OF THE INVENTION

The present invention comprehends an improved thermally responsive integrating sensor assembly which is extremely simple and economical of construction while yet providing an improved temperature sensing functioning.

More specifically, the sensor assembly of the present invention is adapted for providing a warning signal indicating a sensed high temperature condition in a refrigeration apparatus such as a freezer. Co-pending U.S. application Ser. No. 848,242, of James P. Laughlin and Gerald A. Eisenbrandt, (PA-4970-0-UF-USA) entitled "Temperature Sensor Mounting Means" filed Nov. 3, 1977, and owned by the assignee hereof, discloses a freezer employing a sensor assembly sensing device which may utilize the present invention.

The sensor assembly may include a body of synthetic resin material defining an internal cavity and a temperature sensing detector disposed within the cavity to sense the temperature produced thereat by a temperature condition existing outwardly of the body and having its transmission to the cavity controlled jointly by the surface heat transfer coefficient of the body, the thermal conductivity of the body material, and the heat capacity of the body.

In the preferred form of the invention, the synthetic resin material has a substantially constant thermal diffusivity over the desired operating range of the sensor assembly.

The body material preferably comprises a styrenic material, such as high impact polystyrene, or alternatively, a vinyl material, such as rigid polyvinyl chloride.

The resin material preferably has a thermal conductivity of less than approximately $3\times10^{-4}$ calories per centimeter$^2$ second °Centigrade/cm.

The synthetic resin material perferably has a specific heat of at least approximately 0.3 calories/gram °Centigrade.

The synthetic resin material preferably has a thermal diffusivity of less than approximately $0.73\times10^{-3}$ centimeters$^2$/second.

The synthetic resin material in the preferred form of the invention has a specific heat of approximately 0.33 calories/gram °Centigrade.

In the illustrated embodiment, the resin body has a minimum thermal transfer path of approximately 5/16".

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
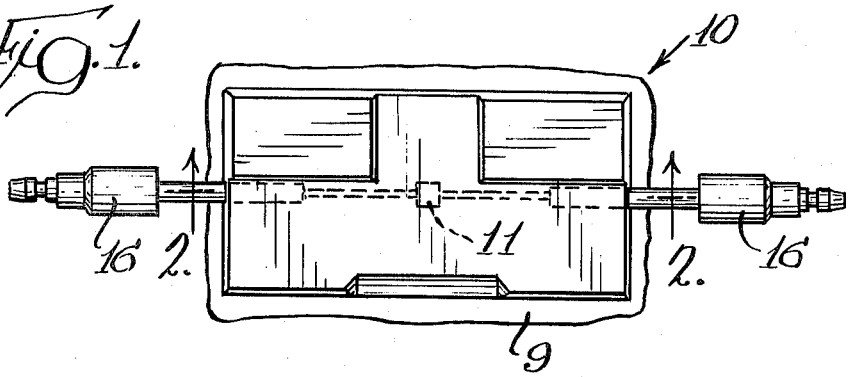
FIG. 1 is a top plan view of a sensor assembly embodying the invention with the sensor assembly shown abutting a fragmentary portion of a freezer liner.
Figure 2:
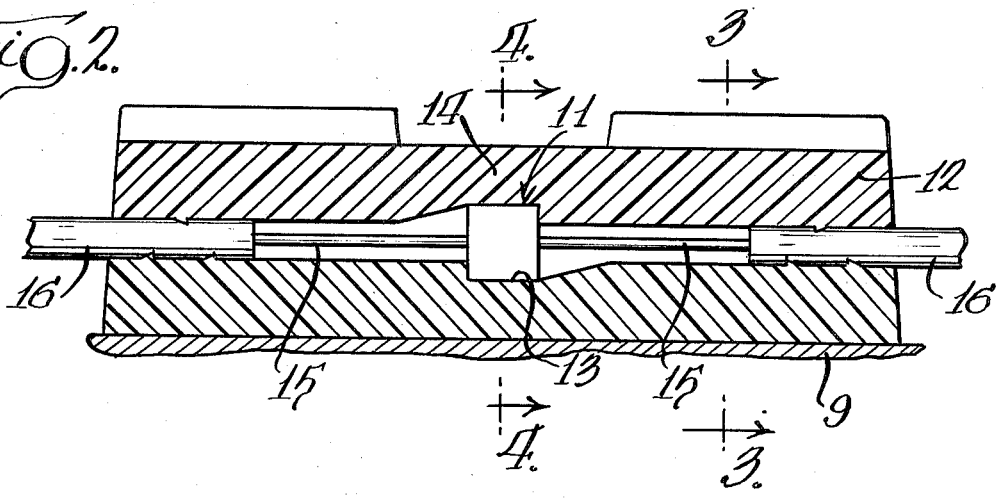
FIG. 2 is a fragmentary enlarged vertical section thereof taken substantially along the line 2—2 of FIG. 1.
Figure 3:
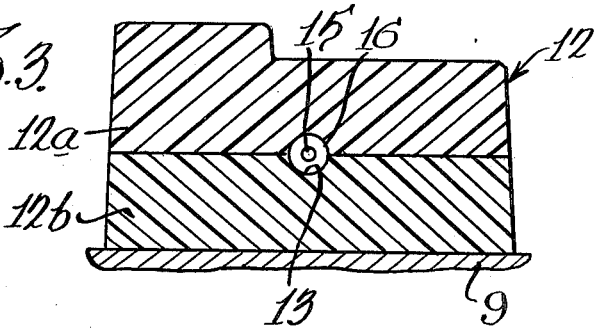
FIG. 3 is a transverse section taken substantially along the line 3—3 of FIG. 1.
Figure 4:
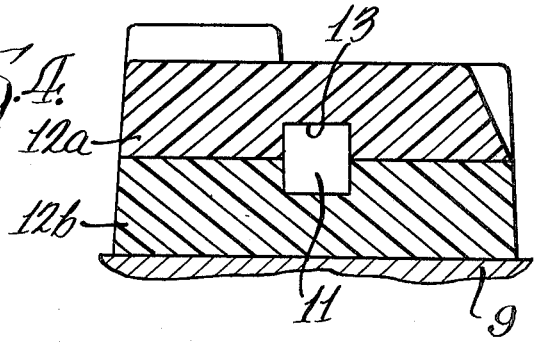
FIG. 4 is a transverse section taken substantially along the line 4—4 of FIG. 2.

In the exemplary embodiment of the invention as disclosed in the drawing, a thermally responsive integrating sensor assembly generally designated 10 is shown to comprise a temperature sensing detector 11 embedded in a body 12 of synthetic resin material. The temperature sensing detector 11 is received in a cavity 13 of the body so disposed therein to define a minimum heat transfer portion, such as portion 14, of approximately 5/16".

In the illustrated embodiment, the temperature sensing detector 11 comprises a thermistor having connector leads 15 electrically connected to splice-type connectors 16 extending outwardly from the body 12.

In the preferred embodiment, body 12 is formed of a styrenic material, such as natural high impact polystyrene. In the illustrated embodiment, the body 12 is formed as a two-piece assembly including an upper portion **12*a* and a lower portion 12*b* cooperatively defining the cavity 13. Portions 12*a* and 12*b* may be bonded as by use of a methyl-ethyl-ketone bonding agent, by the use of ultrasonic welding, etc. The lower portion 12*b* of body 12 is in abutting heat transfer relation with a portion of a freezer liner 9** as indicated in the drawing. Other portions of the freezer have been omitted from the drawing for simplicity in the drawing.

In the illustrated embodiment, the body 12 may have a length of approximately 2½", a height of approximately ⅜", and a width of approximately 1¼". The temperature sensing detector 11 may comprise a disc-type thermistor having a resistance of approximately 5 kohms at 25° C., 23.2 kohms at −6.7° C., and 26.9 kohms at −9.4° C.

Thus, the sensor assembly 10 of the present invention is adapted for use in a freezer to provide an alarm when the temperature sensed by the detector 11 reaches a preselected high value, such as 24° F., or approximately −5° C. Conventionally, the operating temperature in a freezer would be approximately 7° to 12° F. and, thus, when a failure occurs, the temperature will rise from that point to an undesirably high temperature. The sensor assembly 10 provides an automatic time lag, or delay, to avoid providing a signal, such as during a normal defrost operation wherein the temperature may rise to a high temperature but not be maintained at that high temperature for a sufficiently long time to correspond to a malfunction of the freezer.

Illustratively, the time delay may be approximately 10 minutes.

In the illustrated embodiment, as indicated briefly above, the body 12 is preferably formed of a high impact polystyrene which may have a density of approximately 1.05 grams per centimeter$^3$. The thermal conductivity thereof is effectively constant over the range of from about 7° F. to 24° F., comprising the desired operating range of the control. The thermal conductivity may be approximately $2\times10^{-4}$ calories per centimeter$^2$ second °Centrigade per centimeter. The polystyrene material may have a specific heat of approximately 0.33 calories per gram °Centrigrade and may have a thermal diffusivity of approximately $0.577\times10^{-3}$ centimeter$^2$ per second.

As indicated further above, a second advantageous material for use in the invention comprises a rigid polyvinyl chloride having a density of approximately 1.37 grams per centimeter$^3$, a thermal conductivity of $3\times10^{-4}$ calories per centimeter$^2$ second °Centigrade per centimeter over the desired operating range, a specific heat of approximately 0.3 calories per gram °Centigrade, and a thermal diffusivity of approximately $0.730\times10^{-3}$ centimeter$^2$ per second.

Thus, the thermal conductivity, and thermal diffusivity are relatively low for the preferred materials.

Illustratively, where the body 12 was formed of high impact polystyrene and defined a block having a minimal heat transfer portion 14 of 5/16", the time for the center of the block to reach 24° F. where the initial temperature was 12° F. and the increased temperature was 29° F., was approximately 10.2 minutes. Where the material was rigid polyvinyl chloride, the time was approximately 10.8 minutes.

In the sensor assembly 10 of the present invention, the temperature sensing detector 11 comprises a thermistor which may generate a small amount of internal heat in the operation of the device due to its bias current. Illustratively, in the illustrated embodiment, the thermistor generates approximately 0.8 mw ($2\times10^{-4}$ calories per second) of internal heat energy as a result of its bias current. Such an internal heat produces an equilibrium temperature in the assembly of approximately 0.12° C. (0.22° F.) above the ambient temperature where the sensor assembly is arranged to have a surface heat transfer coefficient of approximately $2.7\times10^{-4}$ calories per centimeter$^2$ °Centigrade.

Thus, the present invention comprehends an improved integrating sensor assembly utilizing selectively high impact polystyrene or rigid polyvinyl chloride as the synthetic resin material from which the body 12 is formed. The sensor assembly 10 is described herein as an "integrating" sensor assembly since it continuously integrates i.e. responds to and reflects the heat inputs from the various different temperatures sources or conditions which affect the operation of the freezer. These heat inputs include heat transfer from the freezer liner and the air in the freezer food storage compartment to the synthetic resin body 12, and heat transfer through body 12 to the sensing detector 11 embedded in cavity 13 in body 12. It has been found that the use of high impact polystyrene or rigid polyvinyl chloride material in this application provides a substantial improvement in the operation of the sensor assembly as compared to those sensor assemblies utilizing other synthetic resin material, such as polypropylene, polymethalcrylate, acrylonitrile-butadiene-styrene, RTV, and high density and low density polyethylene resins. Further, the sensor assembly of the present invention provides a substantial improvement over the known devices utilizing metals, such as steel, which function substantially as heat sinks with exponential responses to the sudden temperature changes.

The foregoing disclosure of specific embodiments is illustrative of the broad inventive concepts comprehended by the invention.

The embodiments of the invention in which an exclusive property or privilege is claimed are defined as follows:

1. a thermally responsive integrating sensor assembly for use in providing a delayed warning signal indicating a sensed high temperature condition, said sensor assembly comprising:

a temperature sensing detector;

a body of synthetic resin material defining an outer surface and an internal cavity substantially surrounded by the resin material and spaced within said outer surface approximately 5/16", said detector being disposed within said cavity in heat transfer association with said outer surface solely through said resin material thereby to sense the temperature produced thereat by a temperature condition existing outwardly of said body outer surface and having a preselected thermal transmission to said cavity controlled solely by the parameters of said resin material body including the surface heat transfer coefficient of the body, the thermal conductivity of the body material, and the heat capacity of the body to provide a preselected time delay in sensing said temperature condition, said synthetic resin material having a substantially constant thermal diffusivity over the desired operating range of the sensor assembly.

2. The thermally responsive integrating sensor assembly of claim 1 wherein said body is formed solely of high impact polystyrene synthetic resin.

3. The thermally responsive integrating sensor assembly of claim 1 wherein said synthetic resin material has a thermal conductivity less than approximately $3\times10^{-4}$ cal/cms$^2$ sec °C/cm.

4. The thermally responsive integrating sensor assembly of claim 1 wherein said body is formed solely of polyvinylchloride.

5. The thermally responsive integrating sensor assembly of claim 1 wherein said body is formed solely of rigid polyvinyl chloride.

6. In a freezer, a thermally responsive sensor assembly for use in providing a delayed warning signal indicating a sensed high temperature condition, said sensor assembly comprising:

a temperature sensing detector;

a body of high impact polystyrene synthetic resin material defining an outer surface and an internal cavity substantially surrounded by the resin material, said cavity being spaced from the outer surfaces of the body approximately 5/16", said detector being disposed within said cavity in thermal contact with said body and in heat transfer association with said outer surface solely through said resin material thereby to sense the temperature produced thereat by a temperature condition existing outwardly of said body outer surface and having a preselected thermal transmission to said cavity controlled solely by the parameters of said resin material body including the surface heat transfer coefficient of the body, the thermal conductivity of the body material, and the heat capacity of the body, said thermal conductivity being less than approximately $3\times10^{-4}$ cal/cm$^2$ sec °C/cm, said resin material having a substantially constant thermal diffusivity of less than approximately $0.73\times10^{-3}$ cm$^2$/sec over the desired operating range of the sensor assembly to provide a preselected time delay in sensing said temperature condition.

7. The thermally responsive integrating sensor assembly of claim 1 wherein said synthetic resin material has a specific heat of at least approximately 0.3 cal/gm°C.

8. The thermally responsive integrating sensor assembly of claim 1 wherein said synthetic resin material has a thermal diffusivity of less than approximately $0.73\times10^{-3}$ cm$^2$/sec.

9. The thermally responsive integrating sensor assembly of claim 1 wherein said temperature detector comprises a current carrying element in thermal contact with said body of synthetic resin.

10. The thermally responsive integrating sensor assembly of claim 1 wherein said synthetic resin material has a specific heat of approximately 0.33 cal/gm°C.

* * * * *